US005997321A

United States Patent [19]

Nakata et al.

[11] Patent Number: 5,997,321

[45] Date of Patent: Dec. 7, 1999

[54] LEVER-TYPE CONNECTOR

[75] Inventors: Hiroyuki Nakata; Takatoshi Katsuma, both of Yokkaichi, Japan

[73] Assignee: Sumitomo Wiring Systems, Ltd., Japan

[21] Appl. No.: 08/907,898

[22] Filed: Aug. 11, 1997

[30] Foreign Application Priority Data

Aug. 9, 1996 [JP] Japan ..... 8-211663

[51] Int. Cl.[6] ..... H01R 13/62

[52] U.S. Cl. ..... 439/157

[58] Field of Search ..... 439/157, 152–156, 439/158–160, 372

[56] References Cited

U.S. PATENT DOCUMENTS

| | | | |
|---|---|---|---|
| 5,135,408 | 8/1992 | Suzuki | 439/157 |
| 5,344,194 | 9/1994 | Hatagishi et al. | 439/157 |
| 5,509,816 | 4/1996 | Katsuma | 439/157 |
| 5,609,494 | 3/1997 | Yamaguchi et al. | 439/157 |

FOREIGN PATENT DOCUMENTS

| | | | |
|---|---|---|---|
| 0 599 332 | 6/1994 | European Pat. Off. . | |
| 0 658 954 | 6/1995 | European Pat. Off. . | |
| 0 717 466 | 6/1996 | European Pat. Off. . | |
| 195 43 009 | 5/1995 | Germany . | |
| 2260659 | 4/1993 | United Kingdom | 439/372 |

*Primary Examiner*—Paula Bradley
*Assistant Examiner*—Tho D. Ta
*Attorney, Agent, or Firm*—Banner & Witcoff, Ltd.

[57] ABSTRACT

The posterior end of a connector housing 11 has contact supporting members 17 formed thereon, their posterior faces forming arc-shaped guiding faces 17*a* formed so as to correspond to the path of a bendable lock 23 provided on a pivoting operating member 22. When the lever 20 is latched, the bending of the operating member 22 is prevented due to the guiding faces 17*a*. As a result there is no possibility of the operating member 22 bending due to an unintentional external force, and thereby releasing the lock 23.

9 Claims, 6 Drawing Sheets

LEVER-TYPE CONNECTOR

TECHNICAL FIELD

The present invention relates to a lever-type electrical connector.

BACKGROUND OF THE INVENTION

Conventional lever-type connectors are of the sort shown in FIGS. 10 to 12 of this specification.

A lever 2 provided on a lever-type connector 1 is C-shaped and has a pair of arms 3 which are attached to side faces of a connector housing 5 so as to be pivotable. A cam 3*a* provided on an inner face of each arm 3 fits with a protruding member of a corresponding connector housing (not shown) and draws the connector housings together as the lever is pivoted to the closed condition.

An operating member 4 connected between the arms 3 of the lever 2 has a bendable lock 4*a*. When the lever 2 is pivoted to pull the connector housings into a fitted state, the bendable lock 4*a* bends in a resilient manner and fits with a protruding member 5*a* located at the posterior end of the connector housing 5. In order to separate the connector housing 5 and the corresponding connector housing, a pressing member 4*b* of the bendable lock 4*a* is bent and the housing can be separated by pivoting the lever 2 in a direction opposite to the direction described above.

In the prior lever-type connector 1, the aim of making the lever 2 fit with the connector housing 5 is that, as long as the operator does not intentionally release the lock by pushing the pressing member 4*b*, the lever 2 does not pivot in such a direction as to cause the separation of the connector housings.

However, in this prior connector 1, a problem exists in that if a force is applied at locations other than at the pressing member 4*b* as, for example, shown in FIG. 10, where an external force is applied in the direction of the arrows at both ends of the rotating operating member 4, then, as shown in FIG. 12, the entire operating member 4 bends and the lock 4*a* can be released inadvertently.

The present invention has been developed after taking the above problems into consideration, and aims to present a lever-type connector having a highly reliable latch and which does away with the problem of unintentional release.

SUMMARY OF THE INVENTION

According to the invention there is provided a lever type connector comprising a body and a 'C' shaped lever pivoted thereon, the lever having arms pivoted at opposite sides of the body on a common axis, and an operating member linking the arms for arcuate movement, the operating member and body having a releasable flexible latch engageable to hold the operating member at one extreme of said arcuate movement, wherein one of the body and operating member has one or more upstanding support members adapted to prevent flexing of said lever in a manner which would cause inadvertent release of said latch.

The support members of the invention act to prevent deformation except in the region of the latch itself, and thus to prevent accidental release of the latch due to external forces at locations other than that of the latch.

Preferably the support member or members gives support to the operating member. Typically, the latch is provided in a mid region of the operating member, and support members are provided on either side thereof. The support members may give support only in the latched condition, or may include a surface closely following the path of movement of the operating member to give support as the lever is moved to the latched condition.

The latch typically comprises a flexible member and a rigid member, one being provided on the body and the other on the lever.

BRIEF DESCRIPTION OF THE DRAWINGS

Other features of the invention will be apparent from the following description of several preferred embodiments shown by way of example only in the accompanying drawings, in which.

DESCRIPTION OF PREFERRED EMBODIMENTS

Figure 1:
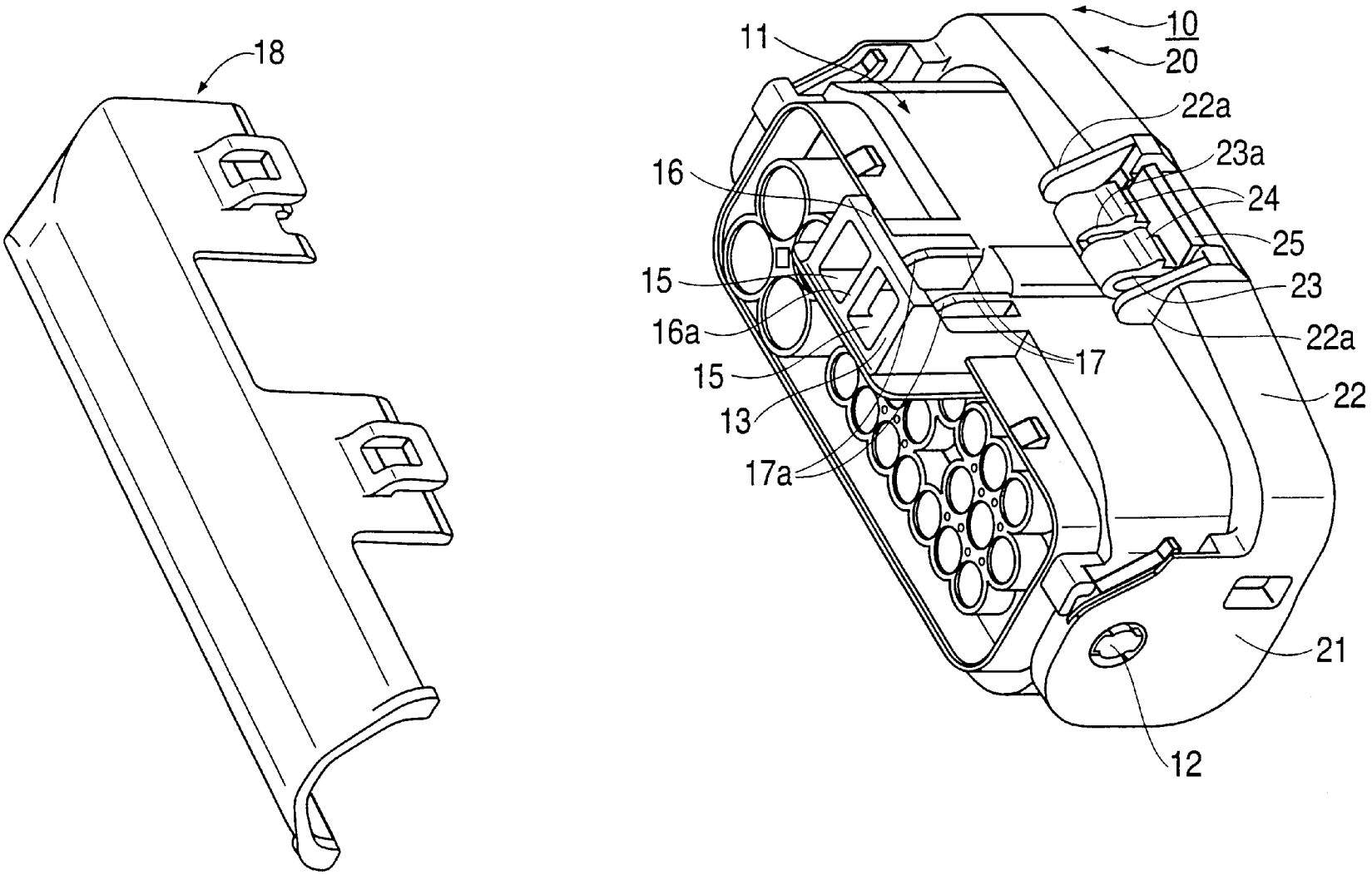
FIG. 1 is a diagonal view of a lever-type connector of the present invention.

With reference to the drawings, a lever-type connector 10 comprises a connector housing 11 made of synthetic resin, the housing 11 housing a plurality of female terminal fittings therein, and having a lever 20 that is made of synthetic resin and which is attached to the connector housing 11 so as to straddle it in its width-wise direction, the lever 20 having overall a C-shape.

Arm members 21 are pivotably fixed to supporting axes 12 provided on both side faces of the connector housing 11. Further, the centre of the posterior end of the upper face of the connector housing 11 has a fitting member 13 protruding in a posterior direction, the fitting member 13 fitting with a bendable lock 23 provided on the lever 20. The fitting member 13 and bendable lock 23 constitute a releasable latch.

This fitting member 13 is formed into a rectangular shape and its side walls gradually increase in height in the posterior direction, and its posterior end has a pair of openings 15 partitioned via a partition 16*a*. The upper edges (hereinafter referred to as connectors 16 or rigid abutments) of these openings 15 allow the bendable lock 23 to be retained therein, and the lever 20 latched.

Figure 2:
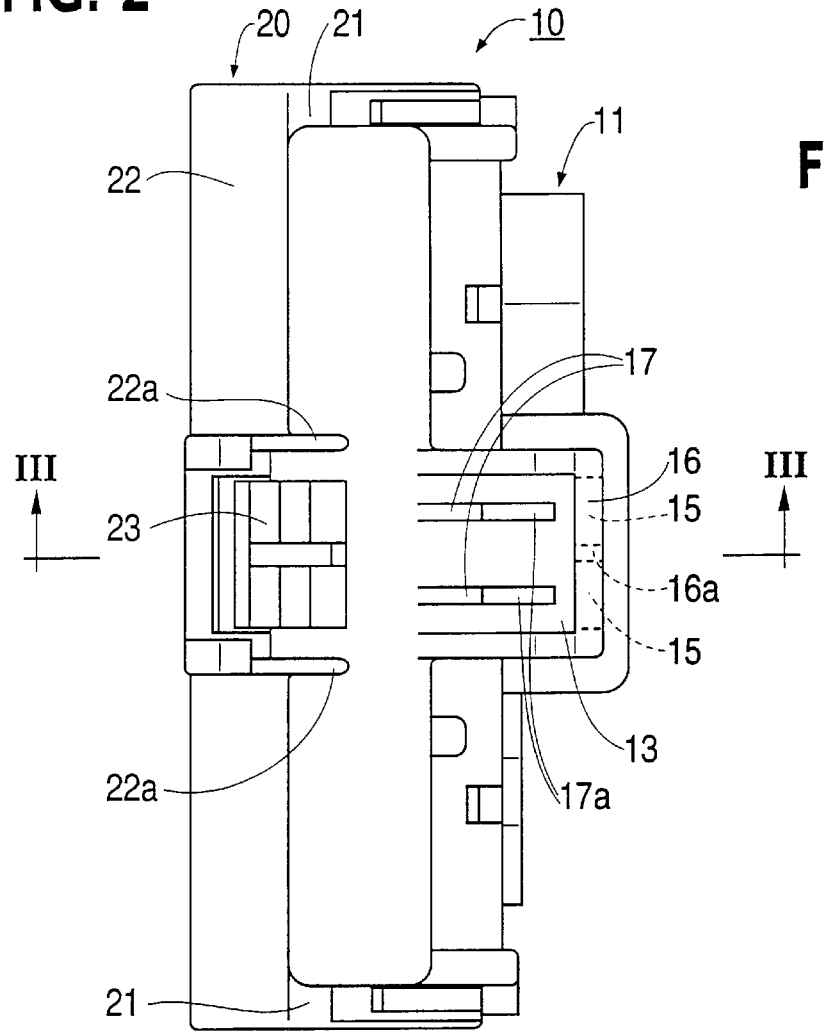
FIG. 2 is a plan view of the lever-type connector of the present invention.

A base face of the fitting member 13 has a pair of rib-shaped contact supporting members 17 (FIG. 2) provided so as to be parallel to the side walls within the frame of the fitting members 13, a specified space being provided between these and the face having the openings 15. The upper edge of each supporting member 17 has an arc-shaped inclining face 17*a* formed thereon; which is formed so as to correspond closely to the path of movement described by the lower face of the bendable lock 23.

The lever 20 has an operating member 22 that connects with the arms 21, and is pivotable from a position (shown in FIG. 3) facing the anterior edge of the upper face of the connector housing 11 to a position (shown in FIG. 4) where it fits with the fitting member 13.

The central portion of the rotation operating member 22 has a pair of protecting members 22*a* formed so as to be separated at a specified distance, the bendable lock 23 being formed between these and separated by a small distance. This bendable lock 23 is formed in a U-shape from the lower edge of the operating member 22. The central portion of the bendable lock 23 has a slit 23*a* cut into it, thereby making it easier for the bendable lock 23 to bend. Towards the anterior end of the lock 23 protrudes a locking protrusion 24 which fits in a resilient manner with the upper edge of the connectors 16. The side of the locking protrusion 24 facing the connectors 16 forms a gently inclining face 24*a* (see FIG. 3), thereby allowing the latching operation with the connectors 16 to be carried out smoothly. The anterior end of the lock 23 has an operating protrusion 25 protruding outwards for performing a lock releasing operation.

Figure 4:
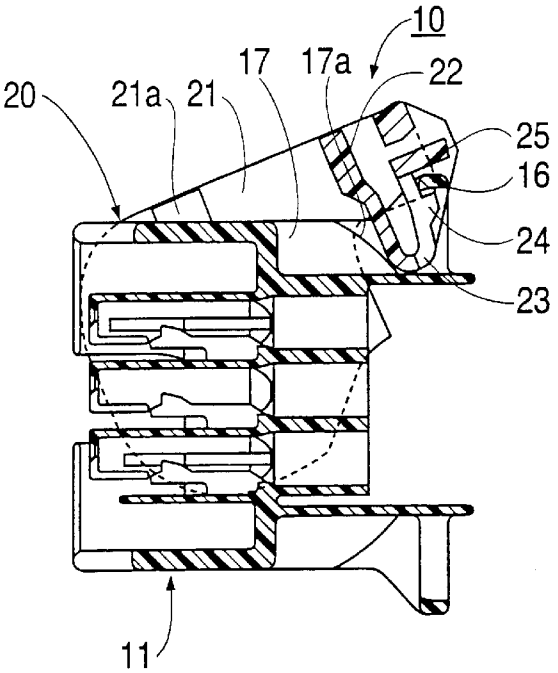
FIG. 4 is a cross-sectional view showing a bendable lock fitted in a fitting member.

When the lever 20 is pivoted, the bendable lock 23 moves the lower face of the base portion of the lock 23 describing an arc along the arc-shaped inclining faces 17*a*. As shown in FIG. 4, in the fitted state, it comes to face the ends of the arc-shaped inclining faces 17*a*. Consequently, in the fitted state, the bendable lock 23 is clamped between the connectors 16 and the arc-shaped inclining faces 17*a*. As long as the lock 23 is not bent by pressing the operating protrusion 25, there is no possibility of inadvertent release taking place. In the conventional lever-type connector there is a problem in that if a parallel external release force applies, the entire operating member 22 bends, thereby releasing the fitting of the locking protrusion 24 and the connector 16. In the lever-type connector 10 of the present embodiment, however, due to the contact of the supporting member 17 with the base portion of the bendable lock 23, bending of the operating member 22 can be prevented. Accordingly, the fitting of the locking protrusion 24 with the connectors 16 cannot be accidentally released.

Further, since the arc-shaped inclining faces 17*a* of the contact supporting member 17 are formed to be shaped so as to correspond to the path described by the lower face of the bendable lock 23, even if the rotation operating member 22 undergoes a change in shape, its bending is corrected by the lock 23 being pushed up by the arc-shaped inclining faces 17*a*, and accordingly the fitting operation of the locking protrusion 24 and the connectors 16 can be carried out with certainty.

Figure 3:
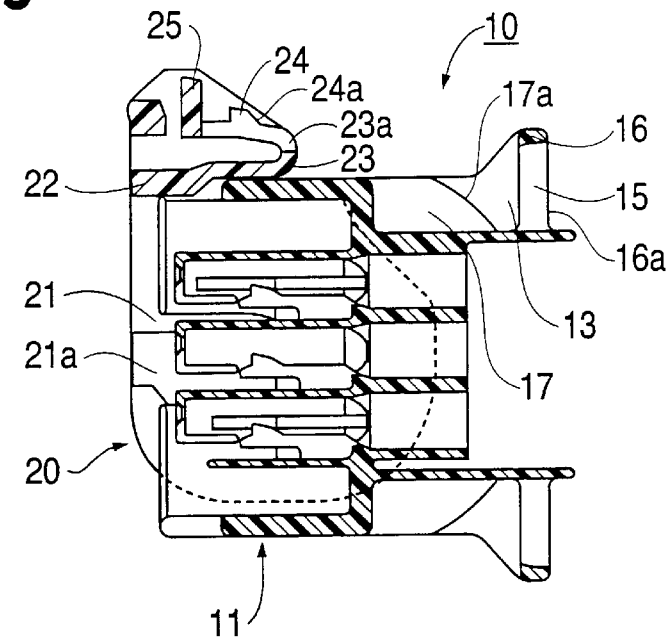
FIG. 3 is a cross-sectional view along III—III of FIG. 2.

As shown in FIG. 3, the inner face of each arm member 21 of the lever 20 has a cam groove 21*a* formed thereon. In the state where the operating member 22 is made to face the anterior side of the connector housing 11, the opening of the cam groove 21*a* faces the fitting protrusion provided on the corresponding connector housing (not shown). When the connector housings are brought together, the fitting protrusion enters into the opening of the cam groove 21*a*. Further, when, as shown in the same figure, the lever 20 is rotated in a clock-wise direction, due to the cam configuration formed by the cam groove 21*a* and the fitting protrusion, the connector housings 11 are pulled towards each other and fit with each other; thus operation is conventional.

The posterior end of the lever-type connector 10 has a cover 18 for protecting an electric wire and thereby allowing the wire to be pulled towards the anterior of the connector housing 11.

Figure 5:
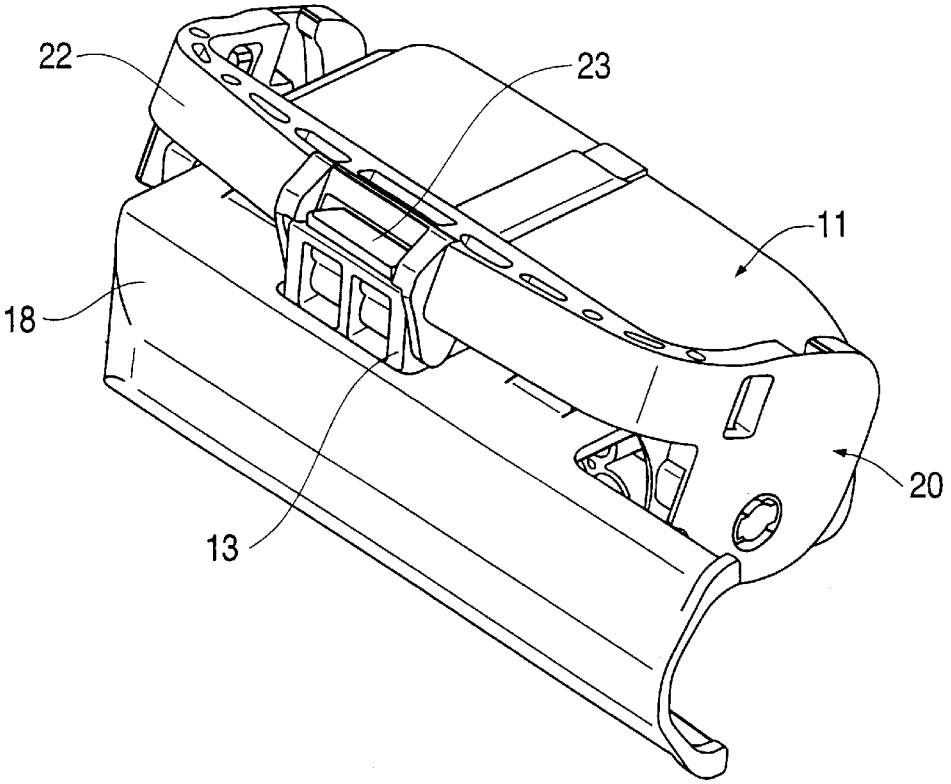
FIG. 5 is a diagonal view showing the bendable lock fitted in a fitting member.

In order to connect the lever-type connector 10 to the corresponding connector, the fitting protrusion of the corresponding connector (not shown) is inserted into the cam groove 21*a* of the lever 20, and the lever 20 is pivoted. When the connector housings are in a completely fitted state with respect to each other, as shown in FIG. 4 and FIG. 5, the bendable lock 23 of the lever 20 and the fitting member 13 of the connector housing 11 are latched and the lever 20 is supported in a fitted state.

In order to separate the lever-type connector 10 from the corresponding connector, the operating protrusion 25 of the bendable lock 23 is pushed and the bendable lock 23 bent. The lever 20 is then moved in a direction that is counter-clockwise with respect to FIG. 4. When this is done, the locking protrusion 24 describes an arc from the connectors 16 at a location displaced from the centre of the rotation. Accordingly, there is no interference between the two, and the lever 20 can be pivoted.

In the state where the lever-type connector 10 and the corresponding connector are in the fitted state, the application of a force at a location other than that of the operating protrusion 25 cannot cause the latch to be released. Consequently, compared to the conventional case, there is no possibility of the operating member 22 bending and consequently causing the release of the lock 23 and the fitting member 13. This results in a highly reliable connected state.

The present invention is not limited to the embodiments described above with the aid of figures. For example, the possibilities described below also lie within the technical range of the present invention. In addition, the present invention may be embodied in various other ways without deviating from the scope thereof.

Figure 6A:
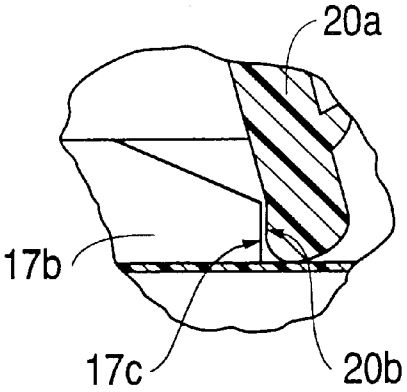
FIG. 6*a* is an enlarged part section showing a modification of variant 1.
Figure 6:
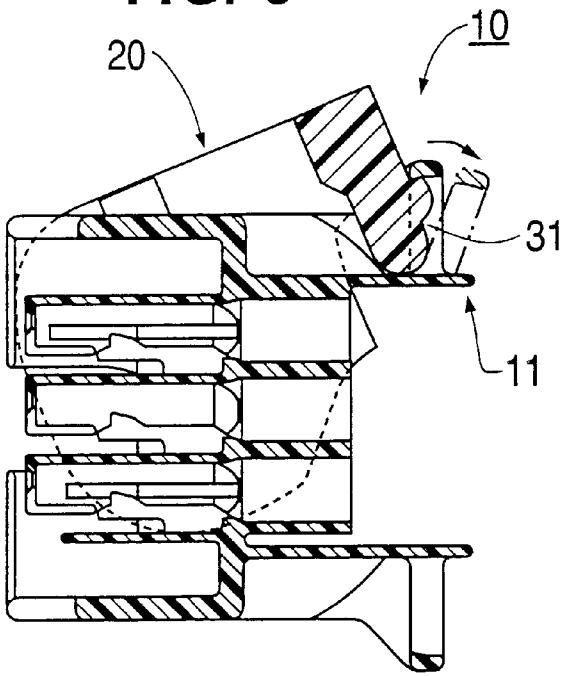
FIG. 6 is a side cross-sectional view of variant 1.

(1) Although in the lever-type connector 10 of the present embodiment the bendable lock 23 is provided on the lever 20, as shown in FIG. 6, it may equally be arranged so that the bendable lack 31 is provided on the connector housing.

(2) As shown in FIG. 6*a*, the supporting member 17*b* and lever 20*a* may have a more positive engagement by making abutment faces 17*c*, 20*b* perpendicular to the housing 11 so that they do not lie on the path of movement of the lever 20—this gives a snap action which is more difficult to release. The same principle can be applied in cases where the flexible part of the latch is provided on the lever.

Figure 7:
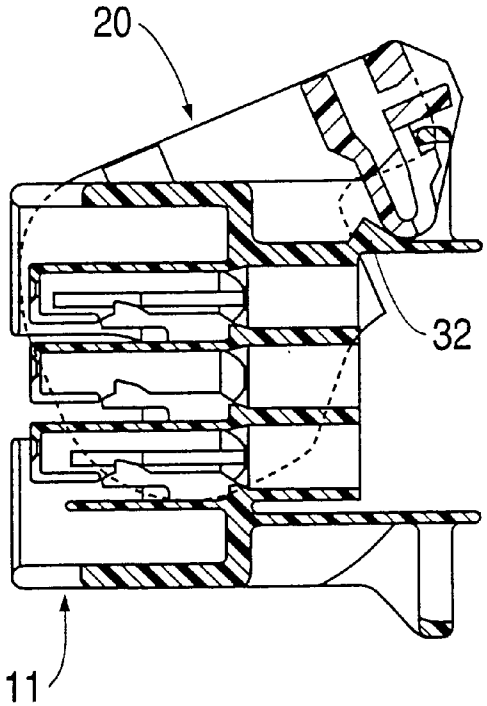
FIG. 7 is a side cross-sectional view of variant 2.

(3) Although the contact supporting members 17 of the present embodiment are formed in the connector housing 11 so as to be rib-shaped, as long as the lever 20 is supported so that it does not bend in the direction of bending of the bendable lock 23, it may equally be arranged so that, as shown in FIG. 7, a protruding contact supporting member 32 is provided.

As described in the present embodiment, the rib-shape in the connector housing 11 also serves to strengthen the connector housing 11. By making the ribs longer, an arc-shaped inclining face can be provided, and even if the lever changes shape, this arc-shaped inclining face corrects the lever to the correct state when the locked state has been reached.

Figure 8:
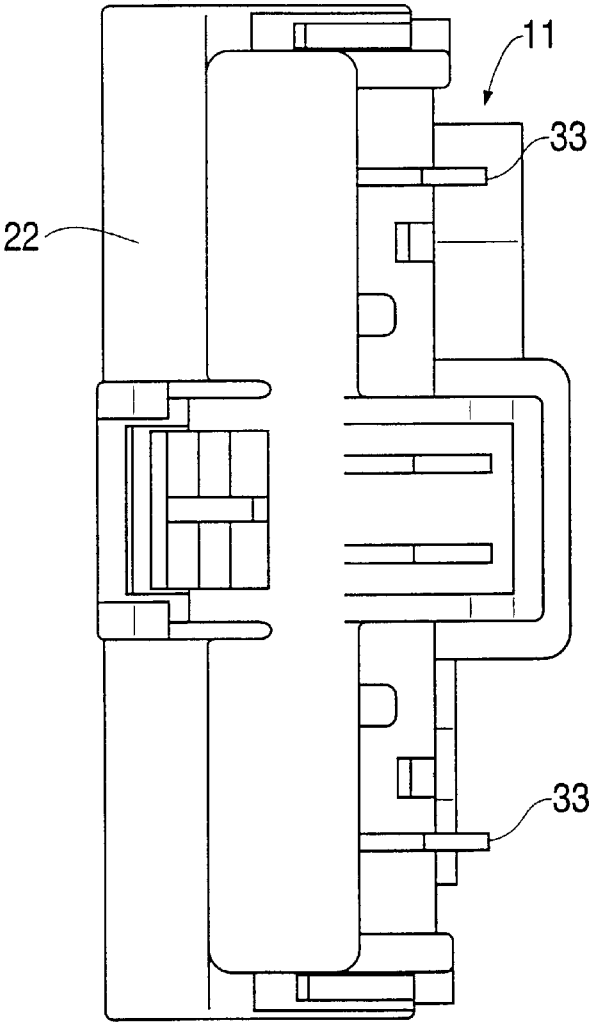
FIG. 8 is a plan view of variant 3.
Figure 10:
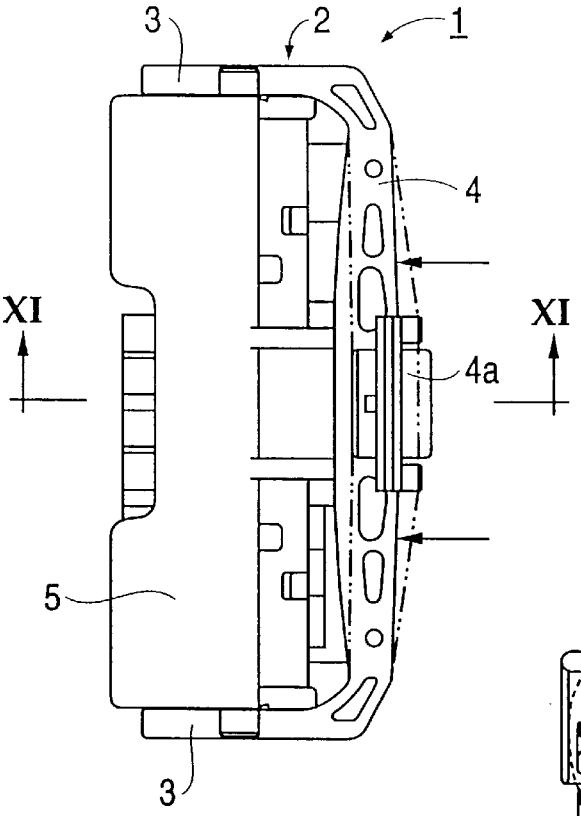
FIG. 10 (PRIOR ART)
FIG. 10 is a plan view of a prior art lever-type connector.
Figure 11:
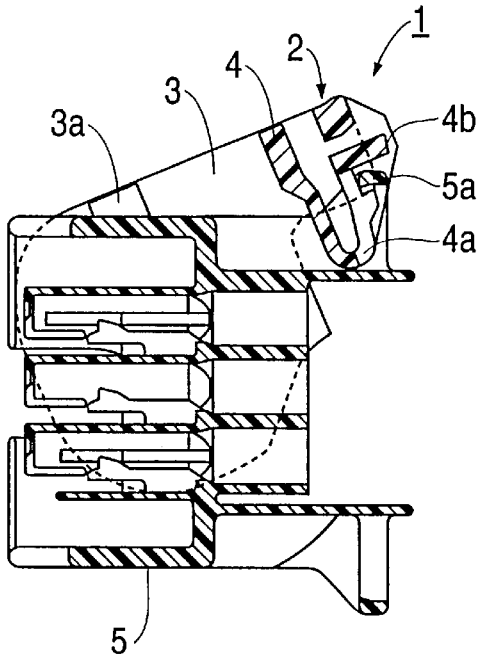
FIG. 11 (PRIOR ART)
FIG. 11 is a cross-sectional view along XI—XI of FIG. 10.
Figure 12:
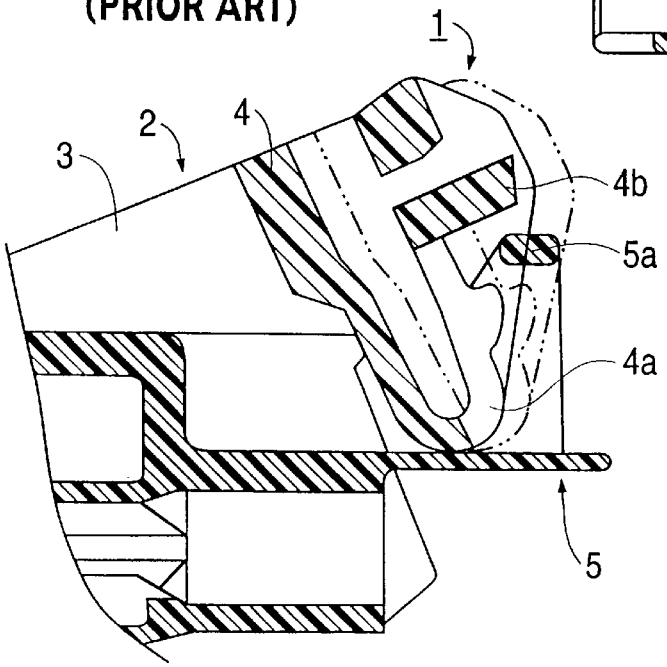
FIG. 12 (PRIOR ART)
FIG. 12 is a partially enlarged part cross-sectional view of the prior art connector.

(4) Further, although the contact supporting members 17 of the present embodiment are provided in a location facing the bendable lock 23, for example, as shown in FIG. 8, it may equally be arranged so that both ends of the operating member 22 have contact supporting members 33 formed thereon.

If the configuration is arranged to be as described in the above embodiment, even if the lever 20 changes shape, the bendable lock 23 itself is arranged so as not to change position by means of the contact supporting members 17, which support the bendable lock 23. Reliability is therefore increased.

Figure 9:
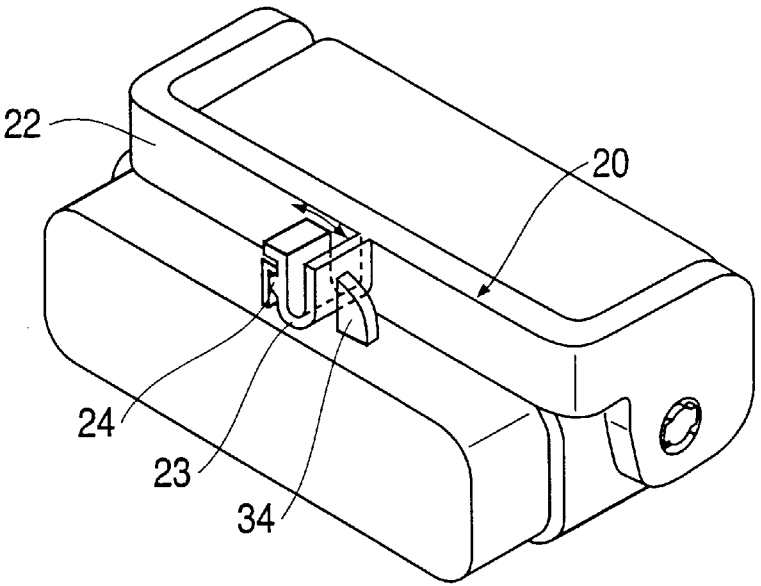
FIG. 9 is a diagonal view of variant 4.

(5) Further, the bendable lock 23 of the present embodiment has a configuration whereby it bends in a direction perpendicular to the axial direction of the operating member 22. However, as shown in FIG. 9, it may equally be arranged to bend in the axial direction of the operating member 22. In such a case, as shown in the figure, a contact supporting member 34 may be provided that makes contact when the lever 20 changes shape in the axial direction. Here, this contact supporting member 34 is normally in close contact with the facing face of the bendable lock 23. If the lever 20 changes shape as described above, it immediately makes contact, thereby preventing unintentional release of the lock.

We claim:

1. A lever type connector comprising a body and a 'C' shaped lever pivoted thereon, the lever having arms pivoted at opposite sides of the body on a common axis, and an operating member linking the arms for arcuate movement of the lever, the operating member and the body each having a latch member, the latch members being releasably engageable with each other to hold the operating member at one extreme end of said arcuate movement, wherein the body has one or more upstanding support members with an outer surface which corresponds to the arcuate path of travel of the lever at least near the one extreme end to prevent inward movement of the lever and thereby prevent flexing of said lever in a manner which would cause inadvertent release of said latch members when the lever is in a fitted state.

2. A connector according to claim 1 wherein said one or more support members is adapted for engagement with said operating member.

3. A connector according to claim 1 wherein said latch members comprise a relatively rigid abutment on said operating member and a flexible latch member on said body.

4. A connector according to claim 1 wherein said lever is symmertrical, the latch member on the operating member is provided in a mid region of said operating member, and a support member is provided adjacent said mid region on each side thereof.

5. A connector according to claim 4 wherein said support members are provided on either side of said mid region.

6. A connector according to claim 1 wherein said latch members comprise a flexible latch member on said operating member and a relatively rigid abutment on said body.

7. A connector according to claim 6 wherein said flexible latch member is 'U' shaped, one end thereof extending from said operating member, and an opposite end thereof being free and having a latch protrusion for engagement with said relatively rigid abutment.

8. A connector according to claim 7 wherein said flexible latch member has one common limb extending from said operating member, and two parallel free limbs divided by a slit and terminating in a respective latch protrusion.

9. A connector according to claim 8 wherein said body has spaced aligned abutments for engagement, one each with a respective latch protrusion, a support member being provided between said aligned abutments.

* * * * *